US005275197A

United States Patent [19]

Finell

[11] Patent Number: 5,275,197

[45] Date of Patent: Jan. 4, 1994

[54] VALVE STRUCTURE FOR A SACK OR THE LIKE TO BE FILLED WITH AIR

[75] Inventor: John Finell, Pietarsaari, Finland

[73] Assignee: Wisapak Oy AB, Pietarsaari, Finland

[21] Appl. No.: 910,327

[22] PCT Filed: Nov. 15, 1990

[86] PCT No.: PCT/FI90/00274

§ 371 Date: Jul. 17, 1992

§ 102(e) Date: Jul. 17, 1992

[87] PCT Pub. No.: WO91/10598

PCT Pub. Date: Jul. 25, 1991

[30] Foreign Application Priority Data

Jan. 17, 1990 [FI] Finland ..... 900272

[51] Int. Cl.[5] ..... F16K 15/20

[52] U.S. Cl. ..... 137/234; 137/223; 137/599

[58] Field of Search ..... 137/223, 233, 234, 513.7, 137/599; 251/351

[56] References Cited

U.S. PATENT DOCUMENTS

| | | | |
|---|---|---|---|
| 588,779 | 8/1897 | Reinach | 137/599 |
| 1,255,354 | 2/1918 | Tischer | 137/223 |
| 2,772,692 | 12/1956 | Russell | 137/223 |
| 2,804,085 | 8/1957 | Geambeardino et al. | 137/223 |
| 3,289,694 | 12/1966 | Frye | 137/513.7 X |
| 3,785,395 | 1/1974 | Andreasson | 137/223 |
| 3,944,084 | 3/1976 | Reeves | 214/10.5 D |
| 3,983,907 | 10/1976 | Sorensen | 137/223 |
| 3,995,653 | 12/1976 | Mackal et al. | 137/223 X |
| 4,015,622 | 4/1977 | Pagani | 137/223 |
| 4,579,141 | 4/1986 | Arff | 137/223 |

FOREIGN PATENT DOCUMENTS

| | | |
|---|---|---|
| 0265243 | 4/1988 | European Pat. Off. . |
| 2435537 | 2/1976 | Fed. Rep. of Germany . |
| 2709665 | 1/1979 | Fed. Rep. of Germany . |
| 54086 | 6/1978 | Finland . |
| 60537 | 10/1981 | Finland . |
| 425233 | 9/1982 | Sweden . |
| 1526229 | 9/1978 | United Kingdom . |

*Primary Examiner*—John Rivell

*Attorney, Agent, or Firm*—Scully, Scott, Murphy & Presser

[57] ABSTRACT

A valve structure for an air sack comprising an essentially cylindrical tubular part extending hermetically from the inside to the outside of the sack and having external threads on the portion outside the sack, a plug with internal threads to be screwed on the external threads of the tubular part to close the end of the tubular part hermetically, and a filling valve in the middle of the plug. To facilitate and accelerate the discharge of air from the sack, the plug is provided with several air exhaust holes within the area surrounding the filling valve. At the end of the tubular part facing the plug there is an inner, preferably annular flange part, the upper surface of which is pressed hermetically against the lower surface of the plug closing the passage of air from the sack when the plug is entirely screwed in its place.

4 Claims, 2 Drawing Sheets

VALVE STRUCTURE FOR A SACK OR THE LIKE TO BE FILLED WITH AIR

BACKGROUND OF THE INVENTION

The invention relates to a valve structure for a sack or the like to be filled with air, which valve structure comprises an essentially cylindrical tubular part extending hermetically from the inside to the outside of the sack and having external threads on the portion outside the sack, a plug with internal threads to be screwed on the external threads of the tubular part to close the end of the tubular part hermetically, and a filling valve in the middle of the plug.

Especially at sea transports, air-filled stowage sacks are used to fill empty spaces between the cargo or between the cargo and the wall of the hold of the ship. A stowage sack prevents the cargo from moving in the hold and facilitates particularly the supporting of an unsymmetrical difficult cargo. The stowage sack is arranged in place empty and it is filled in its place, whereby it expands and adjusts itself to the form of the cargo. When unloading the cargo, the stowage sacks are emptied and removed from between the cargo.

For the use of stowage sacks, it is extremely important that the sacks can be filled and emptied quickly and easily. This is again influenced by the valve structure used in the first place. A prior art valve structure comprises a cylindrical mouthpiece hermetically inserted in a hole of a sack and provided with eternal threads. On this mouthpiece is screwed a plug provided with respective internal threads, which plug closes the end of the mouthpiece hermetically. In the middle of the plug, on its upper surface, is arranged a filling valve, through which the sack can be quickly filled with compressed air by using a special tool. After the sack has been filled, this valve is secured by arranging a special stopper therein. The air is removed from the sack by unscrewing the plug from the mouthpiece. Unscrewing the plug and especially screwing it back for refilling is, nevertheless, a difficult measure, particularly if the worker wears protective gloves. If the plug is not entirely removed from the mouthpiece, the air flows out between the plug and the mouthpiece, but too slowly, as far as the practical needs are concerned.

SUMMARY OF THE INVENTION

The object of the invention is to provide a valve structure, by means of which a sack can be emptied as simply and quickly as possible.

This is achieved by means of a valve structure of the type presented in the prior art preamble, which valve structure is according to the invention characterized in that the plug has several air exhaust holes within the area surrounding the filling valve, and that at the end of the tubular part facing the plug there is an inner, preferably annular flange part, the upper surface of which is hermetically pressed against the lower surface of the plug closing the exhaust holes of the plug, when the plug is entirely screwed in its place. The pitch of the external and internal threads is preferably such that in order to open the passage of air from the sack the plug shall be turned one turn at the most.

In the valve structure of the invention, the air can be removed from the sack by turning the plug only that much that said flange part does not close the passage of air any more, whereby the air flows out quickly through the exhaust holes. Thanks to the invention, it is necessary to unscrew the plug, and therefore it is easy to empty the sack, and a reuse of the sack does not require any inconvenient location procedure, as according to the solution of the prior art. In this manner a valve structure has been provided, which is easy to handle also with protective gloves or mittens on.

BRIEF DESCRIPTION OF THE DRAWINGS

The invention will now be described in greater detail by means of an exemplifying embodiment with reference to the enclosed drawing, in which.

DETAILED DESCRIPTION OF THE PREFERRED EMBODIMENTS

Figure 1:
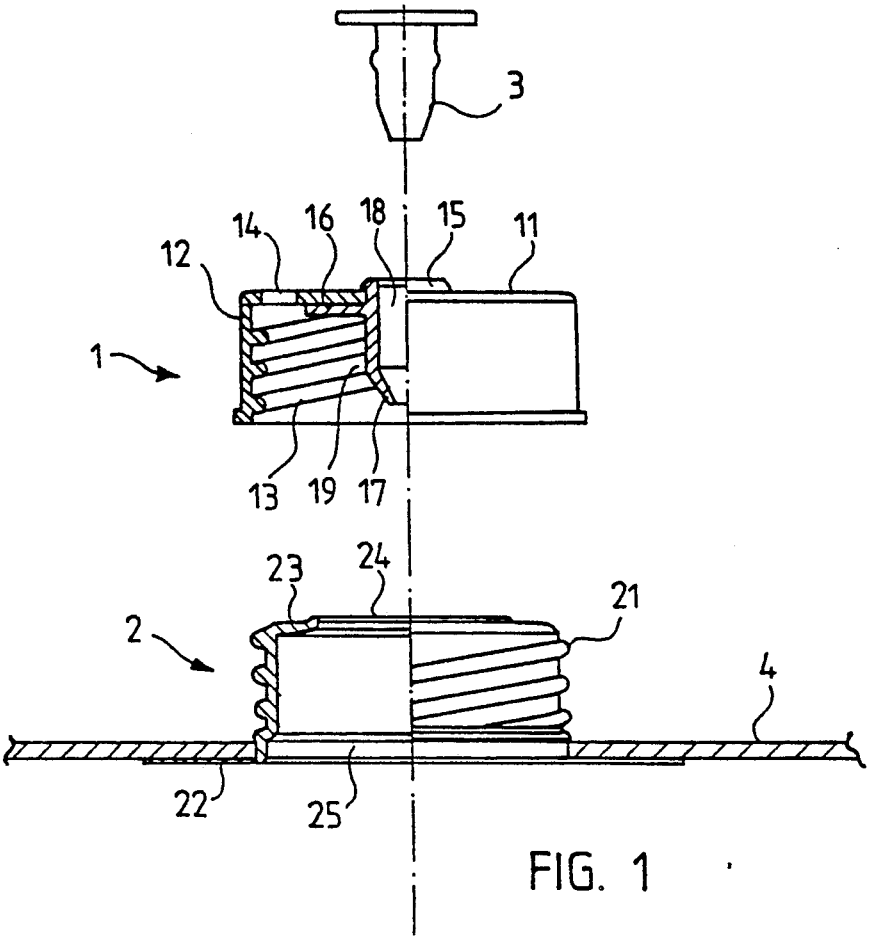
FIG. 1 shows an exploded view, partially in cross-section of a valve structure according to the invention.

FIG. 1 shows three parts of a valve structure according to the primary embodiment of the invention, viz. a plug 1, a mouthpiece 2 and a stopper 3, separated from each other. The parts 1, 2 and 3 are shown in a partial cross-section by using their symmetry axis as a line of separation.

The mouthpiece 2 comprises an essentially cylindrical tubular part, at the lower end of which there is an external flange 22 extending radially sidewards. The mouthpiece 2 is inserted in a hole in a sack material 4 in such a way that the edges of the sack material 4 are arranged on the external flange 22 and fastened thereto hermetically. The sack material 4 is a laminated structure comprising at least one paper layer and at least one airtight plastic layer, which laminated structure is preferably welded to the mouthpiece. Mounted in its place, the mouthpiece 2 forms a tubular part extending from the inside to the outside of the sack and forming an inside channel, the lower end 25 of which opens to the inside of the sack and the upper end 24 of which opens to the outside of the sack. The portion of the mouthpiece 2 outside the sack has an external thread 21 for the plug 1. At the end of the tubular mouthpiece 2 facing the plug 1 there is an inner, preferably annular flange part 23 extending radially inward, on account of which flange part the diameter of the end opening 24 of the mouthpiece 2 is smaller than the inner diameter of the mouthpiece below the flange part 23.

The plug part 1 is a cylindrical tubular part, the lower end of which is open and the upper end of which is closed by an upper wall 11. The side wall of the plug 1 is provided with threads 13 for screwing the plug on the threads 21 of the mouthpiece 2. In an opening in the middle of the upper wall of the plug 1 is inserted a filling valve 15 to feed air into the sack. The filling valve 15 comprises a tubular part 19, the lower end of which tapers off to a conical point 17, whereby a channel with a tapering lower end is formed inside the filling valve 15. The point 17 of the filling valve 15 is flexible and has an open end so that when pushing a nozzle of a pneumatic tool into the channel 18 the point of the filling valve 15 widens making it possible to push the nozzle into the sack and to fill the sack with air. When pulling out the nozzle of the filling tool, the flexible point of the filling valve 15 tapers off again closing the opening at its end and preventing the air from flowing out of the sack. After the filling, the filling valve 15 is closed by means of a stopper to be pushed into the channel 18. The filling valve 15 additionally comprises an external radial flange 16 fastened to the lower surface of the upper wall 11 of the plug 1.

Within the annular area surrounding the filling valve 15 situated in the middle of the upper wall 11 of the plug 1, there are several air exhaust holes 14. In the primary embodiment of the invention shown in FIG. 2, the exhaust holes 14 are situated within the edge area of the upper wall 11 in an annular formation symmetrically with respect to the center axis of the plug 1. The location of the exhaust holes 14 and the size of the inner flange 23 of the mouthpiece 2 are selected in such a way that when the plug 1 is entirely screwed in its place on the mouthpiece 2, the flange part 23 is pressed against the lower surface of the upper wall 11 of the plug 1 closing the exhaust holes 14 hermetically. To empty the sack the plug 1 is unscrewed that much that the flange part 23 is not pressed against the upper wall 11 of the plug 1 any more and does not close the passage of air, whereby the air can quickly flow out of the sack through the mouthpiece 24 and the exhaust holes of the plug 1. The pitch of the internal thread of the plug 1 and the external thread of the mouthpiece 2 has been selected so sharp that to open the passage of air it is not necessary to turn the plug 1 more than one turn at the most, preferably less.

Figure 2:
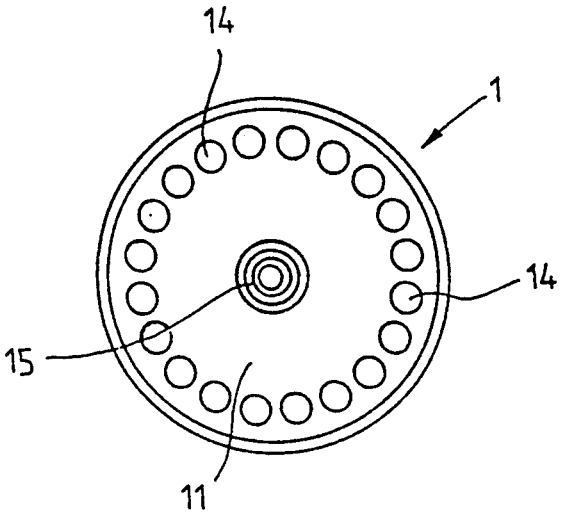
FIG. 2 shows a top view of the plug of the valve structure of FIG. 1.
Figure 3:
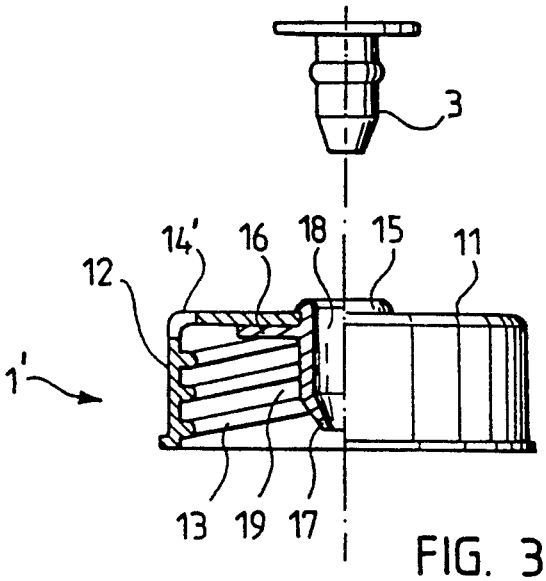
FIG. 3 shows an exploded view, partially in cross section, of another valve structure according to the invention.
Figure 4:
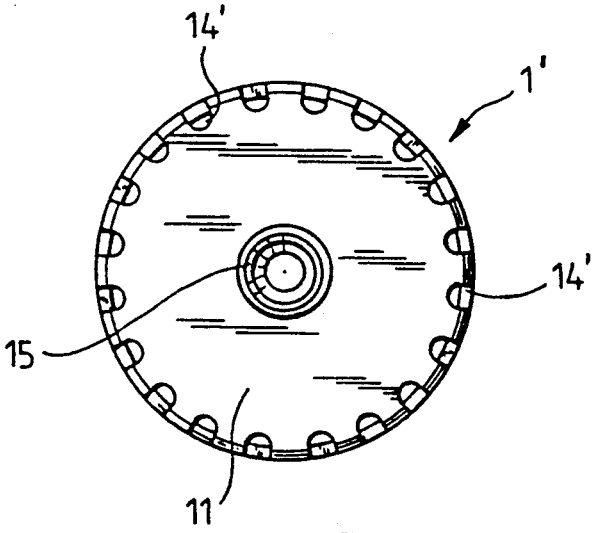
FIG. 4 shows a top view of a plug of the valve structure of FIG. 3.

The location and size of the exhaust holes may differ from that shown in FIGS. 1 and 2. Referring to FIGS. 3 and 4, in another valve structure according to the invention, the exhaust holes 14'open partially or entirely to the side wall of the plug 1'.

The figures and the description relating thereto are only intended to visualize the present invention. As to the details, the valve structure of the invention can vary within the scope of the claims enclosed.

I claim:

1. A valve structure for an air-filled container, comprising:

a tubular element hermetically sealed to the container around an opening therein, and including i) a tubular sidewall forming an open outward end, and ii) an external thread on the tubular sidewall;

a plug including i) a tubular sidewall, ii) an internal thread on the tubular sidewall of the plug, wherein the plug is adapted to be threaded onto the tubular element and into a closed position to close the outward end thereof, iii) a filling valve located in a center of the plug to conduct air through the plug and into the container, the plug forming a plurality of air exhaust openings located outward of the filling valve to discharge air from the container;

wherein the tubular element further includes an inner flange facing the plug; and when the plug is in the closed position, the inner flange is pressed against the plug and prevents the discharge of air from the container.

2. A valve structure according to claim 1, wherein:

the plug is threaded onto and off the tubular element by rotating the plug relative to the tubular element;

the plug has an open position, wherein air from the container is discharged through the air exhaust openings; and the plug is moved from the closed position to the open position by threading the plug, at most, one revolution away from the closed position.

3. A valve structure according to claim 1 or claim 2, wherein:

the plug further includes a top surface, and the plug defines a central axis; and the top surface forms the air exhaust openings, and said exhaust openings are symmetrically arranged with respect to the central axis.

4. A valve structure according to claim 1 or claim 2, wherein the air exhaust openings are formed at least in part by the tubular sidewall of the plug.

* * * * *

UNITED STATES PATENT AND TRADEMARK OFFICE

CERTIFICATE OF CORRECTION

PATENT NO. : 5,275,197

DATED : January 4, 1994

INVENTOR(S) : John Finell

It is certified that error appears in the above-indentified patent and that said Letters Patent is hereby corrected as shown below:

Column 1, line 68: "is necessary" should read --is not necessary--

Signed and Sealed this

Ninth Day of August, 1994

Bruce Lehman

*Attest:*

BRUCE LEHMAN

*Attesting Officer*

*Commissioner of Patents and Trademarks*